United States Patent [19]

Quednau

[11] 4,445,416

[45] May 1, 1984

[54] PLAYER PIANO DEVICES

[76] Inventor: Walter Quednau, 755 Ilex Ct., Lake Park, Fla. 33403

[21] Appl. No.: 195,327

[22] Filed: Oct. 9, 1980

[51] Int. Cl.[3] ..... G10C 3/20

[52] U.S. Cl. ..... 84/244; 84/245

[58] Field of Search ..... 84/243–245, 84/236, 426, 1.05, 313

[56] References Cited

U.S. PATENT DOCUMENTS

| | | | |
|---|---|---|---|
| 1,639,241 | 8/1927 | Venco | 84/245 |
| 4,023,458 | 5/1977 | DeCesare | 84/244 |

*Primary Examiner*—L. T. Hix
*Assistant Examiner*—Benjamin R. Fuller
*Attorney, Agent, or Firm*—Ronald E. Smith

[57] ABSTRACT

Improvements in player piano devices. Repetitive striking of a piano wire by a hammer head associated with a depressed piano key is accomplished by means of a rotating paddle that strikes a projecting portion of the hammer head attendant each revolution of the paddle.

A foot pedal means activates and de-activates a power source that effects rotation of the paddles, there being as many paddles as there are hammer heads.

The means for de-activating the power source also serves to stop the rotation of the paddles and positions the non-rotating paddles in non-interfering relationship with the projecting portion of the hammer heads so that the piano can be played conventionally when desired.

5 Claims, 7 Drawing Figures

PLAYER PIANO DEVICES

BACKGROUND OF THE INVENTION

1. Field of the Invention

This invention relates generally to means for imparting oscillation to a piano hammer head so that it successively strikes its associated piano wire when the piano key individual to it is depressed by a piano player or a player piano mechanism, and more specifically relates to such a means having motor-driven rotating paddles that impinge upon modified hammer head means in a direction opposite to the direction toward which the hammer heads are biased, i.e., in a direction opposite to the rest position of the hammer heads.

2. Description of the Prior Art

The player piano mechanisms of the prior art are complex and therefore costly to manufacture. There is a need for a player piano mechanism that is readily affordable by the average consumer, but no such inexpensive devices are known to the inventor to have been disclosed prior hereto.

There is also a need for a mechanism that can be retrofit into existing conventional pianos, or provided as original equipment, that produces the well-known player piano sound. Preferably, the speed of repetition should be variable, so that the piano could be made to sound like a mandolin or other musical instrument the musical signature of which is characterized by the rapid repetition of the musical notes played. Such a mechanism does not appear in the prior art.

Earlier player piano mechanisms are heavy-handed in that they often cause the piano to get out of tune, thereby necessitating frequent and expensive tune-ups. The identified need for a player piano mechanism having a soft touch has heretofore gone unfulfilled, despite the efforts of many.

SUMMARY OF THE INVENTION

A plurality of laterally disposed rotating paddles corresponding in number to the number of hammer heads in a conventional piano are specifically disposed to strike associated specifically modified hammer heads that have been displaced from their respective rest positions by depression of associated piano keys, in the conventional manner.

The paddles are adjustably mounted on a planar-in-configuration mounting means that is fixedly secured and conjointly rotatable with an elongate shaft that is connected in driven relation to a power source. Each paddle is of bifurcated construction so that the body portion thereof is secured to the mounting means and so that the head portion thereof is free to impinge against its associated modified hammer head attendant each rotation of the shaft. The head portion is flexibly connected to the body portion so that the force of impact of the head portion and the modified hammer head is absorbed to a substantial degree with the result that the piano does not get out of tune prematurely.

Each hammer head is modified by providing it with a hammer head extension means that is essentially an integrally-formed lever having one end thereof spurred to grip the underside of the heel portion of the hammer head, and the other end thereof bent to project into the path of its associated rotating paddle when the piano key individual thereto is depressed. The speed of rotation of the paddle means determines the rapidity with which the modified hammer heads means strike their respective piano wires throughout the duration of the depression of the respective piano keys.

While the particular embodiments shown herein are suitable for use in upright piano applications, it is clear that very similar mechanisms could be employed to adapt the invention to other types of pianos.

A spring stop lever means that is mounted on a second planar-in-configuration mounting means which is axially-spaced from said paddle-carrying mounting means and conjointly rotatable therewith has its rotation terminated by a non-rotating angled member that projects into its path in interruptive relation thereto when the power source is de-activated. In this manner, the rotation of the paddles is terminated when the paddles are disposed in non-interfering relation to the modified hammer heads. More specifically, the spring stop lever means is disposed co-planar with the paddles, but projects radially outward from the rotating shaft in a direction 180° opposite to the direction of paddle projection. The angled member is disposed to interrupt the rotation of the spring stop lever means and hence the rotation of the paddles when said means is disposed in a downward direction, at which time the paddles are disposed in an upward orientation, out of engaging relation with the modified hammer head means spaced downwardly therefrom.

The angled member that interrupts the rotation of the spring stop lever means and hence the paddles is an integrally-formed portion of an upstanding start and stop rod means which in turn carries a power source switch activating/de-activating means. Displacement of the start and stop rod means so that the angled portion thereof interrupts the rotation of said spring stop lever means also effects de-activation of said power source, and displacement of said start and stop rod means to allow rotation of said paddles serves to activate said power source.

It is therefore seen to be a general object of this invention to provide long-needed improvements in player piano mechanisms.

A more specific object is to provide such a mechanism that does not hasten the need for re-tuning the piano.

Another object is to provide a mechanism that can be added to existing pianos or easily provided as original equipment by piano manufacturers that provides the benefit of repetitive note-sounding to produce a fuller sound for all piano players, especially those piano players who for any reason may not be able to completely stretch their hands as desired to give their music the desired degree of expression.

These and other objects will become more apparent as this description proceeds. The invention, accordingly, comprises the many features of construction, arrangement of parts, and combination of elements that will be exemplified in the construction hereinafter set forth, and the scope of the invention will be indicated in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
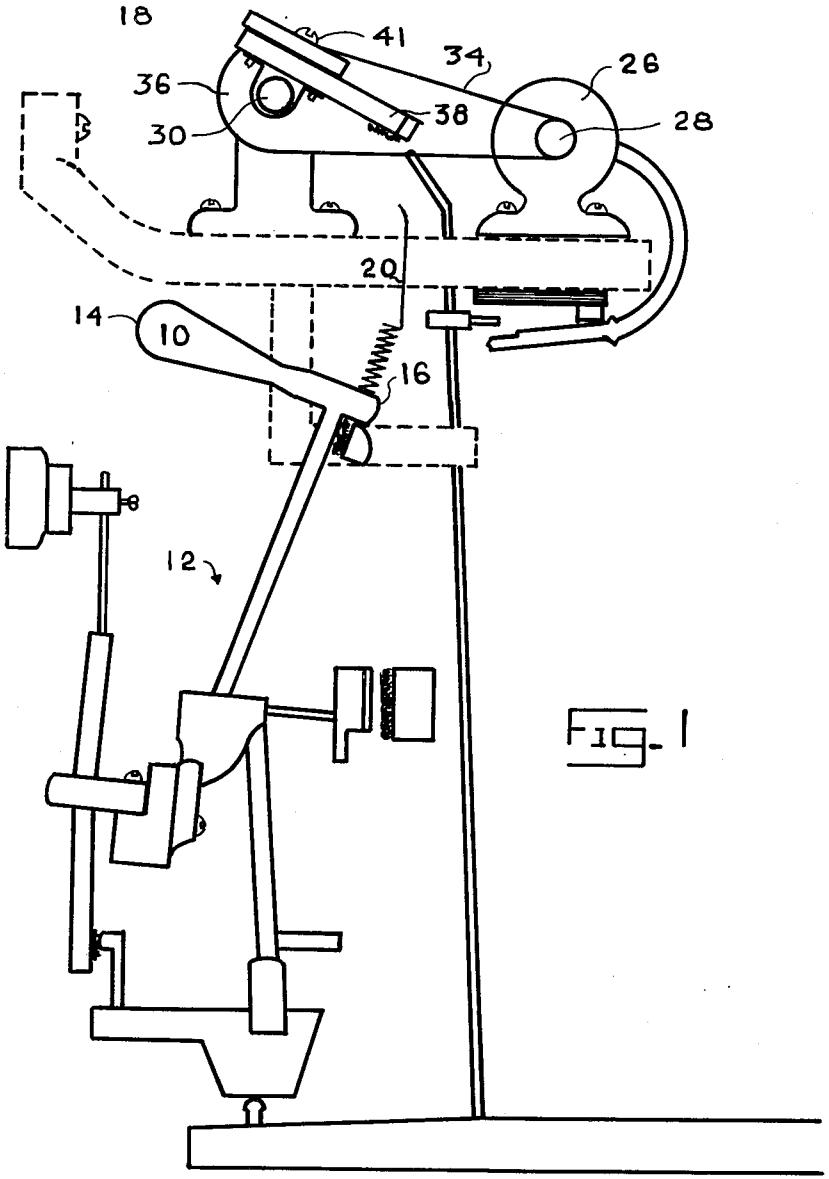
FIG. 1 is a side elevational view of the power source, the rotating paddles, the modified hammer head, and the start and stop rod which carries the power source switch opening/closing means.

The conventional means for interconnecting a piano hammer head 10 to a piano key 11 (FIG. 5) is shown in FIG. 1, and is generally designated 12. Although only one such hammer head 10 and mechanism 12 is shown, it will of course be understood that a plurality (88) of such hammer heads and mechanisms are provided in a conventional piano. The invention will be described substantially in terms of one hammer head 10, to facilitate the description.

The hammer head 10 has a rounded head portion 14 for striking an associated piano wire (not shown) and a heel portion 16. As viewed in FIG. 1, levorotation of the head 10 will cause it to impinge upon its associated piano wire and to thereby produce a musically-pleasing sound. To accomplish the objects of this invention, therefore, a means must be provided to cause a given hammer head 10 associated with a depressed piano key 11 to rapidly oscillate between the rest position depicted in FIG. 1 and its levorotated position (not shown), throughout the duration of such key depression.

Figure 2:
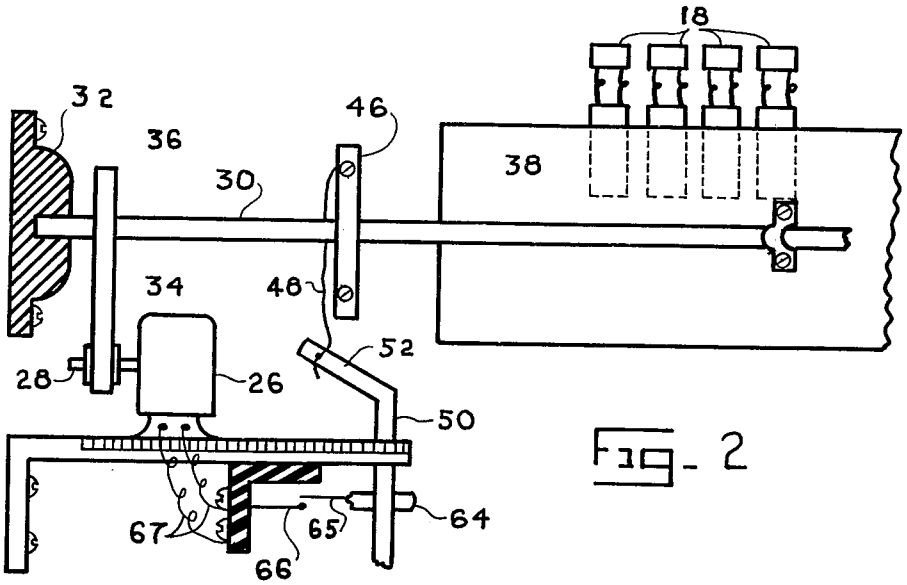
FIG. 2 is a front elevational view showing how the spring stop lever means interrupts the rotation of the paddles when they are collectively disposed in non-interfering relation to the hammer heads.

The preferred means for accomplishing such oscillation comprises a plurality of laterally-disposed rotating paddle means, collectively designated 18 in FIGS. 1 and 2. The paddles 18 indirectly impinge upon and thereby effect momentary levorotation of the respective hammer heads 10 associated with depressed keys 11.

Figure 3:
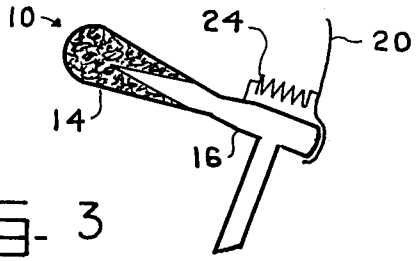
FIG. 3 diagrammatically depicts the hammer head extension means.

The nomenclature "indirectly" is employed because the rotating paddles 18 do not impinge upon the hammer heads 10 directly, but instead impinge upon a hammer head extension means 20 that is shown diagrammatically in FIG. 1 and in detail in FIG. 3. The hammer head extension means 20 is an integrally-formed lever means that has one end thereof complementally formed relative to the heel 16 of the hammer head 10 so that said heel 16 is slideably received therein, and the other end thereof is bent substantially orthogonally to the longitudinal axis of the hammer head 10. This bent portion 22 projects into the path of a dextrorotating paddle means 18 and effects substantially simultaneous levorotation of the hammer head 10, as desired, when struck. A bias means in the form of a coil-type compression spring 24 maintains the lever 20 and the hammer head heel portion 16 in slide fitting engagement at all times.

A power source in the form of a variable speed electric motor 26 (FIGS. 1 and 2) imparts rotation to said paddle means 18. More particularly, the motor 26 has an output shaft 28 that is connected in driving relation to a spaced-apart, parallel, rotatably mounted shaft 30 that has its opposed ends journaled in opposed end thrust bearings 32, only one of which is shown in FIG. 2, by means of a conventional belt 34 and pulley 36 arrangement. The paddles are laterally disposed, as aforesaid, and adjustably secured to a flat, generally rectangular mounting means 38 that is fixedly secured to the rotatable shaft 30 and therefore conjointly rotatable therewith.

Figure 4A:
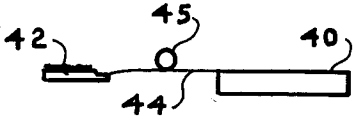
FIGS. 4A and 4B are side elevation and plan views of the preferred paddle means, respectively.
Figure 4B:
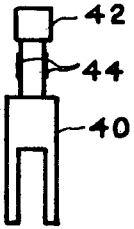
Figure 6:
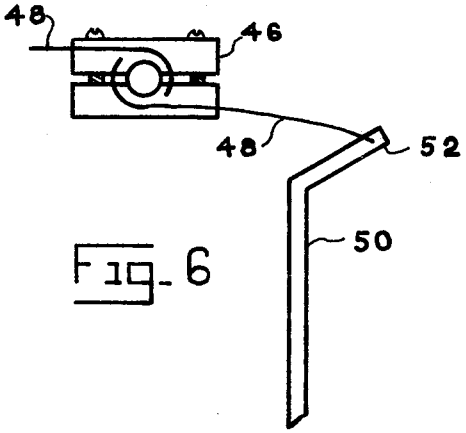
FIG. 6 is a side elevation showing how the angled portion of the start and stop rod interrupts the rotation of the spring stop lever means, two positions of said lever means being shown.

FIGS. 4A and 4B show that each paddle 18 has a slotted body portion 40 for reception therethrough of a screw means 41 (FIG. 1) and a head portion 42 connected thereto in co-planar rlation by a pair of spaced, parallel, flexible wire-like means 44 each of which has a coil portion 45 formed therein. It is the head portion 42 of the paddle means 18 that strikes the hammer head extension means 20 attendant each revolution of the rotating shaft 30. The wire-like means 44 absorbs a portion of the forces of impact therebetween, and thus serve to prevent the premature re-tuning of the piano.

When it is desired to play the piano in a conventional manner, i.e., without the benefit of the inventive apparatus, the motor means 26 is de-activated, and the paddles 18 are collectively secured in a fixed, non-rotating position that does not interfere with the normal operation of the hammer heads 10 and the extension means 20 secured thereto.

The inventive apparatus now to be described serves to de-activate the motor means 26 and to secure the paddle means 18 as desired, responsive to only one operator-initiated step. In such manner, the piano operator, or player, need not remember to secure the paddles 18 after de-activating the motor means 26. As shown in FIG. 2, a second mounting means of planar configuration 46 is fixedly secured to the rotating shaft 30, in axially-spaced relation to the first-mentioned paddle-carrying mounting means 38. A spring stop lever means 48 is fixedly secured to this second-mentioned mounting means 46 and is specifically mounted thereon so that when the paddle means 18 are collectively disposed in an upwardly direction as shown in FIG. 2, (and therefore in non-interfering relation to the hammer head extension means 20 disposed downwardly thereof as clearly shown in FIG. 1), then said spring stop lever means 48 is disposed 180° therefrom, i.e., in a downwardly projecting direction.

Figure 5:
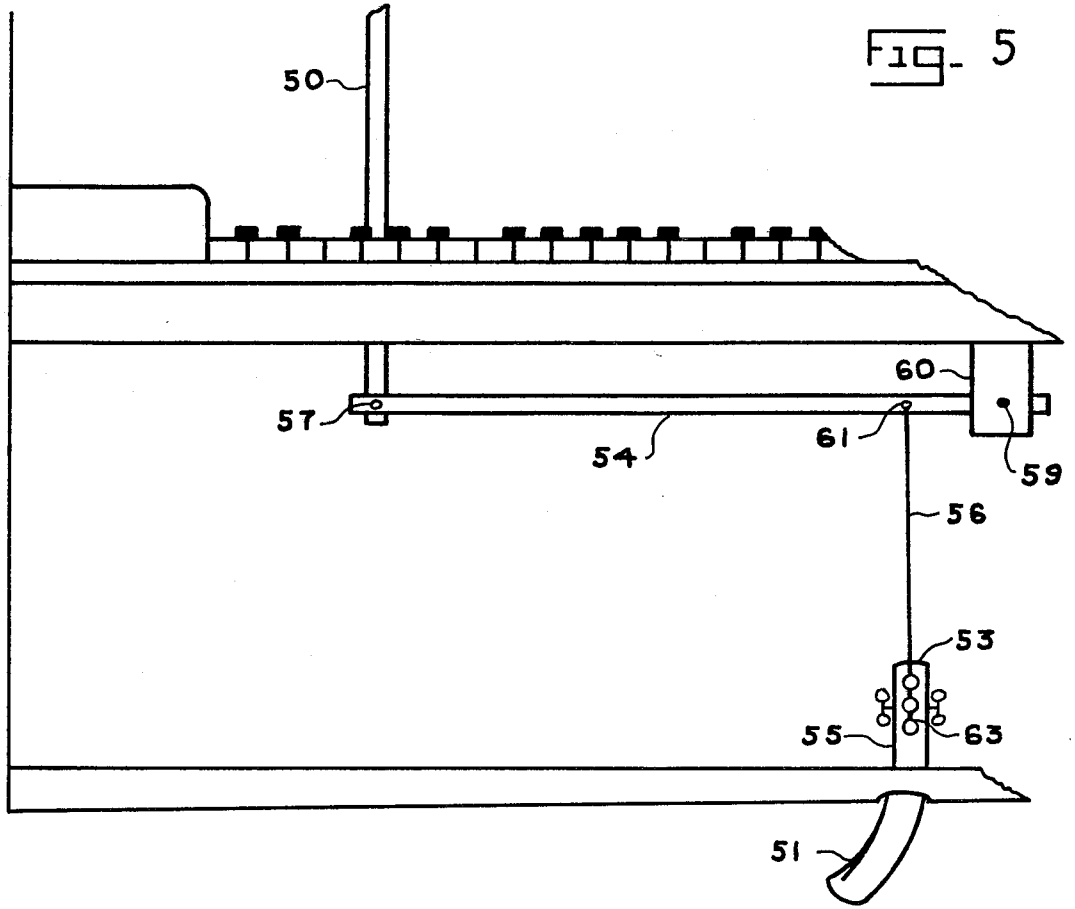
FIG. 5 is a front elevation showing the linkage that interconnects the start and stop rod with a foot pedal means.

A vertically oriented start and stop rod 50 is disposed downwardly of the second mounting means 46, and has a bent portion 52 that interferes with the rotation of the spring stop lever means 48 when the heel portion 51 of a foot pedal 55 (FIG. 5) is depressed, as shown in FIGS. 2 and 5. Such depression of the heel portion 51 of the pedal 55 drives the start and stop rod 50 upwardly, coincident with its longitudinal axis, through horizontal link 54 and vertical link 56. The horizontal link 54 is pivotally secured at one end thereof as at 57 to the lower end of the start and stop rod 50, and has its other end pivotally secured as at 59 to a pivot plate 60. The vertical link 56 is pivotally secured to the horizontal link 54 adjacent one end thereof as at 61 and is secured at its other end to the toe portion 53 of the pedal 55 as at 63. Accordingly, depression of the toe portion 53 of the pedal 55 acts to pull the start and stop rod 50 in a downwardly direction, along its longitudinal axis, i.e., out of engagement with the spring stop lever 48.

This upward and downward travel of the start and stop rod 50 responsive to foot pedal 55 manipulation is also harnessed to start and stop the motor means 26. As shown in FIG. 1, the start and stop rod 50 carries a collar means 64 that has a switch-activating projection 65 that opens and closes switch 66 attendant upward and downward travel, respectively, of the start and stop rod 50. Thus, upward travel of the start and stop rod 50 opens switch 66 and hence de-activates motor means 26 (said motor means 26 being electrically-connected to the switch 66 by leads 67) and also stops the rotation of the paddles 18 by interfering with the rotation of the spring stop lever means 48 as aforesaid. Downward travel of the start and stop rod 50 closes the switch 66, thereby activating motor 26, and frees the spring stop lever means 48 and hence the paddles 18.

Of course, the paddles are specifically disposed and dimensioned to strike their associated hammer head extension means 20 only when the piano key 11 associated with such hammer head extension means 20 is depressed.

It is clear that the inventive apparatus can be supplied as original equipment by the piano manufacturer, or retrofit into existing upright conventional pianos or player pianos. In either event, the simplicity of the construction is such that little cost is incurred by the installation of the inventive system, although the benefits derived therefrom are substantial.

It will thus be seen that the objects set forth above, and those made apparent by the preceding description, are efficiently attained, and since certain changes can be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention to cover all of the generic and specific features of the invention herein described, and all statements of the scope of the invention, which as a matter of language might be said to fall therebetween.

Now that the invention has been described,

That which is claimed is:

1. An apparatus for causing a piano hammer head to repeatedly strike its associated piano wire, attendant depression of its associated key, for the duration of such key depression, comprising, a motor means having an output shaft, an elongate rotatably mounted shaft connected in drive relation to said output shaft, a first mounting block means fixedly secured to and conjointly rotatable with said rotatable shaft, a plurality of flexible paddle means corresponding in number to the number of said piano wires and adjustably secured, in lateral relation to one another, to said rotatable first mounting block means, a hammer head extension means attached to each of said hammer heads, each of said hammer head extension means specifically disposed in path-interruptive relation to an associated one of said flexible paddle means attendant rotation thereof so that each rotation of said first mounting block means causes said flexible paddle means to impinge upon and momentarily displace said hammer head extension means and hence said hammer head into transient piano wire-impinging relationship, means for disabling said paddle means from impinging upon said hammer head extension means when it is desired to play said piano in a conventional mode of operation, said disabling means also serving to de-activate said motor means so that said paddle means impinges upon said hammer head extension means only when said motor means is activated, said disabling means at least in part comprising a second mounting block means fixedly secured to and hence conjointly rotatable with said elongate rotatable shaft, said second mounting block means axially spaced a predetermined distance from said first mounting block means, a spring stop lever means fixedly secured to said second mounting block means and specifically disposed to project outwardly therefrom in substantially co-planar relationship therewith, a first, movably mounted, two position, link member, means for moving said first link member from a first position to a second position, said first position of said first link member disposing one end of said link member in path-interruptive relation to said rotatable spring stop lever means, said spring stop lever means-carrying second mounting block means specifically oriented so that when rotation of said second mounting block means is terminated by said end of said first link member, disposed in path-interruptive relation thereto when said first link member is in said first position, the conjoint rotation of said paddle means is also terminated and said paddle members are collectively disposed in non-interfering relation to said hammer head extension means, thereby allowing said piano to be played in a conventional fashion.

2. The apparatus of claim 1, wherein said disabling means further comprises, a collar member carried by said first link member, a switch-activating projection member attached to and projecting from said collar member, a switch member electrically connected to said motor means, said switch-activating projection member specifically disposed to throw said switch member into its motor de-activating position when said first link member is moved into its spring stop lever means path-interruptive position, and said switch-activating projection member specifically disposed to throw said switch member into its motor activating position when said first link member is moved into its spring stop lever non-path-interfering position.

3. The apparatus of claim 2, wherein said means for moving said first link member from a first position to a second position comprises, a foot-depressable pedal means, a second link member disposed in generally upstanding configuration, having one end thereof attached to said pedal means, the other end of said second link member pivotally secured to a substantially horizontally-disposed third link member adjacent one end thereof, a pivot plate fixedly secured to the frame of said piano, said third link member having one end thereof pivotally secured to said pivot plate and the other end thereof pivotally-secured to said first link member adjacent one end thereof, said first link member disposed in substantially upstanding configuration so that depressing said foot pedal effects longitudinally downward-directed travel of said second link member and hence of said first link member as communicated thereto by said pivotally mounted, horizontally-disposed third link member.

4. The apparatus of claim 3, wherein said paddle means comprises a bifurcated member having its two portions interconnected by a flexible means, said portions thereof comprising a head portion and a body portion, said head portion adapted to impinge upon said hammer head extension means attendant rotation of sid first mounting block means, said body portion slotted for adjustable engagement with said first mounting block means so that said body portion and hence said head portion of said paddle means may be moved toward or away from said hammer head extension means such that extension of said paddle means toward said hammer head extension means increases the force with which said head portion thereof strikes said hammer head extension means and such that retraction of said paddle means away from said hammer head extension means decreases the force with which said head portion thereof strikes said hammer head extension means, such greater or lesser striking force resulting in louder or quieter musical tones emanating from said piano wires attendant impinging thereon of said hammer heads, respectively.

5. The apparatus of claim 4, wherein said hammer head extension means comprises, an integrally-formed lever means having a heel portion that is complementally-formed relative to the heel portion of a hammer head means so that the heel portion of said hammer head means is slidingly received within said complementally-formed heel portion, said integrally-formed lever means having a projecting portion bent substantially orthogonal to said heel portion thereof so that said projecting portion extends into the path of the rotating paddle means associated therewith when said pedal means is depressed, said integrally-formed lever means and said hammer head means maintained in juxtaposition by a bias means so that displacement of said integrally-formed lever means responsive to impingement thereon by said head portion of said paddle means is communicated to said hammer head means with the result that said hammer head means is displaced and caused to impinge upon its associated piano wire.

* * * * *